US011111878B2

(12) United States Patent
Licht et al.

(10) Patent No.: US 11,111,878 B2
(45) Date of Patent: Sep. 7, 2021

(54) PISTON OF AN INTERNAL-COMBUSTION ENGINE

(71) Applicant: Mahle International GmbH, Stuttgart (DE)

(72) Inventors: Philipp Licht, Stuttgart (DE); Rainer Scharp, Vaihingen (DE)

(73) Assignee: Mahle International GmbH

( * ) Notice: Subject to any disclaimer, the term of this patent is extended or adjusted under 35 U.S.C. 154(b) by 0 days.

(21) Appl. No.: 16/666,385

(22) Filed: Oct. 28, 2019

(65) Prior Publication Data

US 2020/0132016 A1 Apr. 30, 2020

(30) Foreign Application Priority Data

Oct. 29, 2018 (DE) ..... 10 2018 218 497.6

(51) Int. Cl.

| | |
|---|---|
| ***F02F 3/22*** | (2006.01) |
| ***F02F 3/00*** | (2006.01) |
| ***F02F 3/14*** | (2006.01) |
| ***F02F 7/00*** | (2006.01) |
| *F01P 3/00* | (2006.01) |

(52) U.S. Cl.

CPC ..... *F02F 3/22* (2013.01); *F02F 3/0069* (2013.01); *F02F 3/14* (2013.01); *F02F 7/007* (2013.01); *F01P 2003/006* (2013.01); *F02F 2003/0061* (2013.01)

(58) Field of Classification Search

CPC ..... F02F 3/16; F02F 3/22; F02F 3/225; F02F 3/0069; F02F 3/14; F02F 7/007; F02F 2003/0061; F01P 2003/006; F01P 3/10

See application file for complete search history.

(56) References Cited

U.S. PATENT DOCUMENTS 2,558,224 A 6/1951 Six
2,865,348 A * 12/1958 Kramer ..... F02F 3/22 123/41.35
3,189,010 A * 6/1965 Isley ..... F02B 23/0675 123/41.35
3,221,718 A * 12/1965 Isley ..... F02B 23/0675 123/41.35
3,545,341 A * 12/1970 Fischer ..... F02F 3/22 92/176

(Continued)

FOREIGN PATENT DOCUMENTS

DE 19960913 A1 * 6/2001 ..... F02F 3/22
DE 10 2006 013 884 A1 9/2007

(Continued)

OTHER PUBLICATIONS

English abstract for DE-10 2009 056 922.

(Continued)

*Primary Examiner* — Hung Q Nguyen
(74) *Attorney, Agent, or Firm* — Fishman Stewart PLLC

(57) ABSTRACT

A piston of an internal-combustion engine may include a piston head and a piston skirt, a cooling duct circulating in the piston head, a boss for receiving a piston pin, and a feed hopper for supplying cooling oil into the cooling duct. The feed hopper may be fastened to another component of the piston via a retaining lug by at least one of a material closure, a force closure, and a positive closure.

20 Claims, 3 Drawing Sheets

(56) References Cited

U.S. PATENT DOCUMENTS

| | | | | | |
|---|---|---|---|---|---|
| 4,648,309 | A * | 3/1987 | Schellmann | F16J 1/02 | 123/193.6 |
| 5,027,757 | A * | 7/1991 | Pusic | F02F 1/22 | 123/65 A |
| 5,058,489 | A * | 10/1991 | Iwaya | F16J 1/04 | 92/233 |
| 6,032,619 | A * | 3/2000 | Zhu | F02F 3/003 | 123/41.35 |
| 6,240,828 | B1 * | 6/2001 | Fujimoto | F02F 3/02 | 92/214 |
| 7,603,977 | B2 * | 10/2009 | Heidrich | F02F 3/22 | 123/193.6 |
| 7,921,555 | B2 * | 4/2011 | Benz | B22D 21/007 | 29/888.04 |
| 8,065,984 | B2 * | 11/2011 | Issler | F02F 3/22 | 123/193.1 |
| 8,939,114 | B2 | 1/2015 | Keller | | |
| 9,341,137 | B2 * | 5/2016 | Leitl | F02F 3/22 | |
| 10,240,557 | B2 | 3/2019 | Boczek et al. | | |
| 2002/0178910 | A1 * | 12/2002 | Keller | F02F 3/22 | 92/208 |
| 2007/0039460 | A1 * | 2/2007 | Scharp | F02F 3/22 | 92/186 |
| 2007/0113802 | A1 * | 5/2007 | Mihara | F16J 1/01 | 123/41.35 |
| 2011/0185992 | A1 * | 8/2011 | Gniesmer | F01P 1/04 | 123/41.39 |
| 2012/0222644 | A1 * | 9/2012 | Bing | B23P 15/10 | 123/193.6 |
| 2013/0000572 | A1 * | 1/2013 | Maruyama | F01P 3/10 | 123/41.35 |
| 2013/0008395 | A1 * | 1/2013 | Keller | F02F 3/22 | 123/41.39 |
| 2013/0333657 | A1 * | 12/2013 | Nodi | F02F 3/022 | 123/193.6 |

FOREIGN PATENT DOCUMENTS

| | | | | | |
|---|---|---|---|---|---|
| DE | 10 2009 056 922 | A1 | | 6/2011 | |
| DE | 10 2011 106 379 | A1 | | 1/2013 | |
| DE | 10 2011 106 381 | A1 | | 1/2013 | |
| DE | 10 2014 015 946 | A1 | | 5/2016 | |
| DE | 10 2016 200 084 | A1 | | 7/2017 | |
| DE | 10 2016 221 353 | A1 | | 5/2018 | |
| JP | 04357369 | A | * | 12/1992 | F02B 23/0672 |
| JP | 105-60010 | A | | 3/1993 | |
| JP | 08312453 | A | * | 11/1996 | F02F 3/22 |
| JP | 11132101 | A | * | 5/1999 | F02F 3/22 |
| JP | 2001-12222 | A | | 1/2001 | |
| JP | 2005090448 | A | * | 4/2005 | F02F 3/22 |

OTHER PUBLICATIONS

English abstract for DE-10 2016 200 084.
English abstract for JP-2001-12222.
English abstract for JP-H05-60010.
English abstract for DE-10 2016 221 353.

* cited by examiner

PISTON OF AN INTERNAL-COMBUSTION ENGINE

CROSS-REFERENCE TO RELATED APPLICATIONS

This application claims priority to German Patent Application No. DE 10 2018 218 497.6, filed Oct. 29, 2018, the contents of which are hereby incorporated by reference in its entirety.

TECHNICAL FIELD

The present invention relates to a piston of an internal-combustion engine, with a piston skirt and with a piston head. The invention relates, in addition, to an internal-combustion engine with at least one such piston.

BACKGROUND

From DE 10 2009 056 922 A1 a piston with a cooling duct circulating in a piston head is known which is covered downwardly—that is to say, towards the piston skirt—by means of a cooling-duct cover. A feed hopper for supplying cooling oil into the cooling duct protrudes into a feed aperture in the cooling-duct cover. In this case, the feed hopper has been secured to the cooling-duct cover.

From DE 10 2011 106 379 A1 once again a generic piston of an internal-combustion engine is known, wherein a cooling duct which has been provided exhibits a feed bore in which a feed hopper has been secured.

From DE 10 2016 200 084 A1 a piston of an internal-combustion engine is known having a circulating cooling duct, wherein an oil-collecting tube has been mounted in or on the inlet of the cooling duct by means of an EMPT method.

A disadvantage of the pistons known from the prior art is either that the feed hopper has been arranged on the cooling-duct cover, and in this case said cooling-duct cover has to participate in taking up the additional inertial forces of the feed hopper, or that the feed hopper has been arranged directly in or on the feed aperture on the piston, distinctly restricting the flexibility as regards the arrangement of the feed hopper, since in this case the feed aperture has been drilled at a predefined place.

SUMMARY

The present invention is therefore concerned with the problem of specifying, for a piston of the generic type, an improved or at least an alternative practical form which, in particular, enables a more flexible design and arrangement of a feed hopper in a cooling duct.

In accordance with the invention, this problem is solved by the subject-matter of the independent claims. Advantageous practical forms are the subject-matter of the dependent claims.

In the case of a piston, known as such, of an internal-combustion engine, the present invention is based on the general idea of equipping, for the first time, a feed hopper for supplying cooling oil into a cooling duct with a retaining lug, and of fastening the feed hopper directly to the piston via this retaining lug by material closure, by force closure and/or by positive closure. The piston according to the invention possesses a piston skirt and also a piston head and a cooling duct circulating in the piston head. Furthermore, the piston according to the invention possesses a boss for receiving a piston pin and for connecting to a connecting rod. Cooling oil can be supplied into the cooling duct via the aforementioned feed hopper. By virtue of the fastening, according to the invention, of the feed hopper to the piston via the retaining lug of said feed hopper, a fastening, undertaken hitherto, to a cooling-duct cover can be dispensed with, having the great advantage that the cooling-duct cover can be designed to be thinner and less stable in itself, since it no longer has to take up the mass-induced inertial forces of the feed hopper. Through the use of thinner and hence also lighter cooling-duct covers, the economic viability of an of the internal-combustion engine equipped with such a piston can be enhanced. With the feed hopper according to the invention it is also possible no longer to have to arrange said feed hopper, even in the case where a cooling-duct cover is present, in a joint region of the cooling-duct cover, but substantially to be able to choose an arrangement that can be chosen freely. As a result of this, it is also possible to use overall, for instance, larger and heavier feed hoppers, in particular also with a standpipe, without being dependent on the cooling-duct cover and the position of a joint.

In an advantageous practical form of the solution according to the invention, the feed hopper has been soldered, welded, screwed or glued to the piston via its retaining lug. Gluing, welding or soldering enables especially a fully automated connection, without further working steps in respect of the retaining lug of the feed hopper or in respect of the piston having to be performed for this purpose. Purely theoretically, a screw coupling is also conceivable, making possible the great advantage of a possibility of disassembly of the feed hopper.

In an advantageous further development of the solution according to the invention, the feed hopper has been fastened via its retaining lug to an inside of the piston skirt or to the boss. An inside of the piston skirt offers especially in this case a lot of room in order to fasten the retaining lug. The retaining lug in this case possesses a shape designed to be complementary to the inner wall of the piston skirt, and therefore preferentially bears against the inner wall in planar manner. For instance, a transition from the inner wall to a slipper-skirt wall can also be chosen here, in which case the retaining lug may, for instance, exhibit a sharp bend.

In another advantageous practical form of the solution according to the invention, the cooling duct exhibits a feed aperture through which the feed hopper protrudes. In this case it is conceivable that a cooling-duct cover—for instance, a cooling-duct metal sheet—has been provided which exhibits a feed aperture through which the feed hopper protrudes. In this case there may also be provision that the feed hopper is not in contact with the cooling-duct cover. In the case of the piston according to the invention, by reason of the fact that the feed hopper has no longer been secured to the cooling-duct cover the feed aperture can be arranged independently of the joint of the cooling-duct cover which has ordinarily been formed from two parts, resulting in distinctly increased flexibility.

In order to prevent an undesirable or excessive drainage of oil from the cooling duct through an annular gap between the edge of the feed aperture and the feed hopper, it is expedient to close the gap, entirely or partially, by a suitable sealing element. This can be done by an appropriate geometrical configuration of the feed hopper, for example in the form of a headed flange directed radially outwards. Instead of being realised integrally with the feed hopper, the sealing element may also have been realised as an additional component part, for example as a rubber gasket surrounding the feed hopper in the form of a ring. Similarly, the sealing element could be formed by the application of a sealing compound which closes the annular gap or at least makes it smaller.

The feed hopper expediently exhibits a diverting device via which cooling oil injected into the feed hopper is diverted in the peripheral direction of the cooling duct and distributed there. By this means, a distinctly improved cooling action can be achieved, since an undesirable return flow of the cooling oil injected into the cooling duct via the feed hopper back into the cooling duct via the feed aperture is preferentially avoided, so that said cooling oil firstly passes through the cooling duct until it arrives at the drainage aperture.

In another advantageous practical form of the solution according to the invention, the feed hopper takes the form of a slotted sheet-metal shaped part. This offers the particular advantage of being able to produce the feed hopper not only inexpensively but also in fully automated manner and hence highly precisely. Such a feed hopper taking the form of a slotted sheet-metal shaped part can furthermore be produced inexpensively and with a comparatively small sheet thickness, since the feed hopper merely has to bring about a supply of cooling oil into the cooling duct, as a result of which the mass-induced inertial forces of the feed hopper can be kept comparatively slight. By this means, the retaining forces or connecting forces required between the retaining lug of the feed hopper and the piston can also be kept slight.

Further important features and advantages of the invention result from the dependent claims, from the drawings and from the associated description of the Figures with reference to the drawings.

It will be understood that the aforementioned features and the features yet to be elucidated below can be used not only in the respectively specified combination but also in other combinations or on their own, without departing from the scope of the present invention.

Preferred embodiments of the invention are represented in the drawings and will be elucidated in more detail in the following description, wherein identical reference symbols refer to identical or similar or functionally identical components.

BRIEF DESCRIPTION OF THE DRAWINGS

Shown in the drawings, in each instance schematically, are:

FIG. 1 a sectional view through a piston, according to the invention, of an internal-combustion engine, with a feed hopper arranged in accordance with the invention via its retaining lug, FIG. 2 a representation analogous to FIG. 1, but from a different perspective, FIG. 3 a sectional view through the piston according to the invention according to FIG. 1, once again from a different perspective, FIG. 4 a representation from below, with a view of the feed hopper of the piston according to the invention, FIG. 5 a sectional view through a feed hopper, a cooling-duct cover and a sealing element closing the annular gap situated in between.

DETAILED DESCRIPTION

Figure 1:
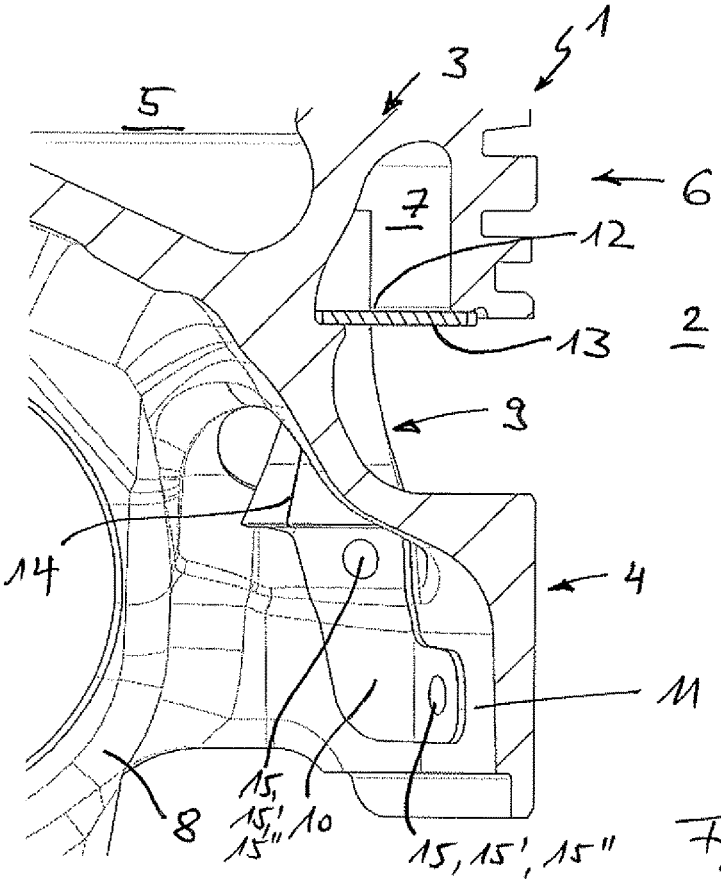

Corresponding to FIGS. 1 to 4, a piston 1, according to the invention, of an internal-combustion engine 2, not drawn in other respects, exhibits a piston head 3 and also a piston skirt 4. The piston head 3 possesses, in known manner, a recess 5, facing towards a combustion chamber, and also a circulating annular portion 6 with corresponding grooves in which piston rings, not shown, are received. Likewise, the piston 1 according to the invention possesses a cooling duct 7, circulating in the piston head 3, and also a boss 8 for receiving a piston pin, not shown, via which the piston 1 is connected to a connecting rod, likewise not shown, of the internal-combustion engine 2. A feed hopper 9 for supplying cooling oil into the cooling duct 7 has been provided in addition. In accordance with the invention, this feed hopper 9 now possesses a retaining lug 10 which, in particular, has been integrally formed with the feed hopper 9 and via which it has been fastened to the piston 1 by material closure, by force closure and/or by positive closure.

The retaining lug 10 in this case preferentially exhibits a shape designed to be complementary to the region of the piston 1 against which the retaining lug 10 bears when the feed hopper 9 has been mounted, so that a planar abutment of the feed hopper 9, via its retaining lug 10, against the piston 1 is made possible. A connection of the retaining lug 10 to the piston 1 can be effected, for instance, with the aid of gluing, welding, soldering, or screwing or riveting.

If the retaining lug 10 is considered more closely, it can be discerned that it exhibits an L-shaped form, wherein a lower L-shank extends in the peripheral direction of the piston 1, whereas the vertical L-shank extends almost parallel to the piston axis. By this means, a particularly stiff and good fastening of the feed hopper 9 to the piston 1 can be obtained.

If FIGS. 1 to 4 are considered, it can be discerned that the feed hopper 9 has been fastened via its retaining lug 10 to an inside 11 of the piston skirt 4. Alternatively, it is of course also conceivable that the retaining lug 10 has been connected to the boss 8 or to a slipper-skirt wall, not shown, the piston 1 in the latter case taking the form of a slipper-skirt piston.

In the present case, in all the practical forms shown the cooling duct 7 takes the form of an open cooling duct and possesses a feed aperture 12 through which the feed hopper 9 protrudes. The cooling duct 7 has been closed in the direction of the piston skirt 4 by means of a cooling-duct cover 13 in which the feed aperture 12 has been arranged. The feed hopper 9 in this case is preferentially not in contact with an edge of the feed aperture 12 but passes through the feed aperture 12 into the cooling duct 7 in contactless manner.

In another advantageous practical form of the solution according to the invention, the feed hopper 9 exhibits a diverting device 16 via which cooling oil injected into the feed hopper 9 is diverted in the peripheral direction of the cooling duct 7 and thereby can be uniformly distributed in said cooling duct, as a result of which a uniform and efficient cooling of the piston 1 can be obtained. In addition, the feed hopper 9 may take the form of a slotted sheet-metal shaped part, as a result of which said feed hopper can be produced not only inexpensively but also in fully automated manner and hence in high quality. The slotted practical form in this case is to be discerned from the slot 14 of the feed hopper 9.

Figure 2:
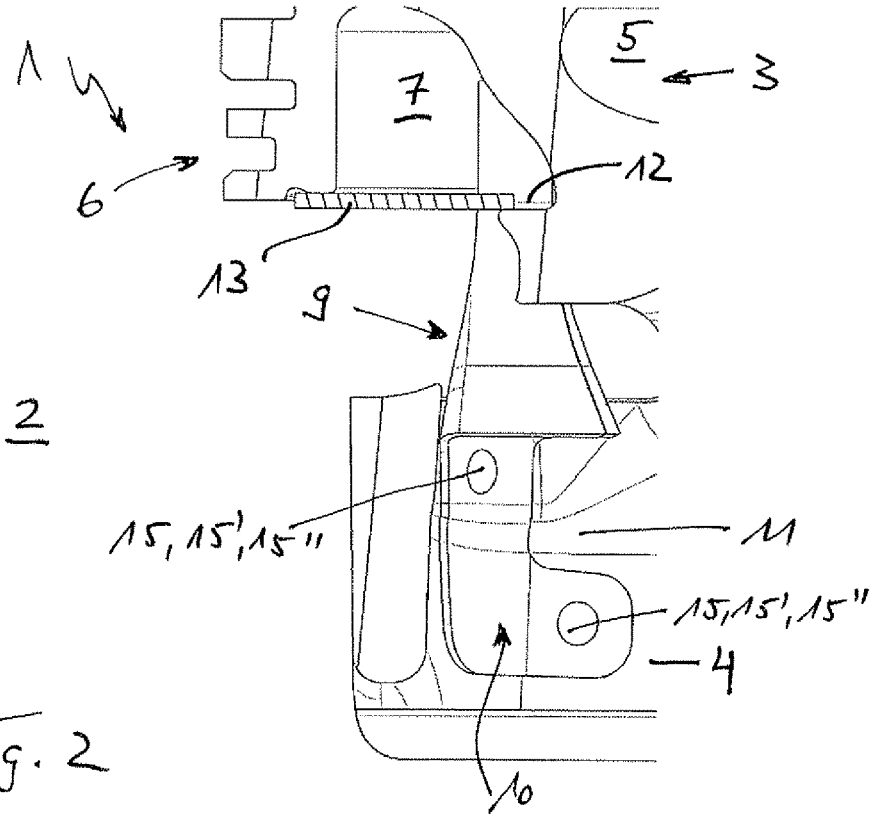
Figure 3:
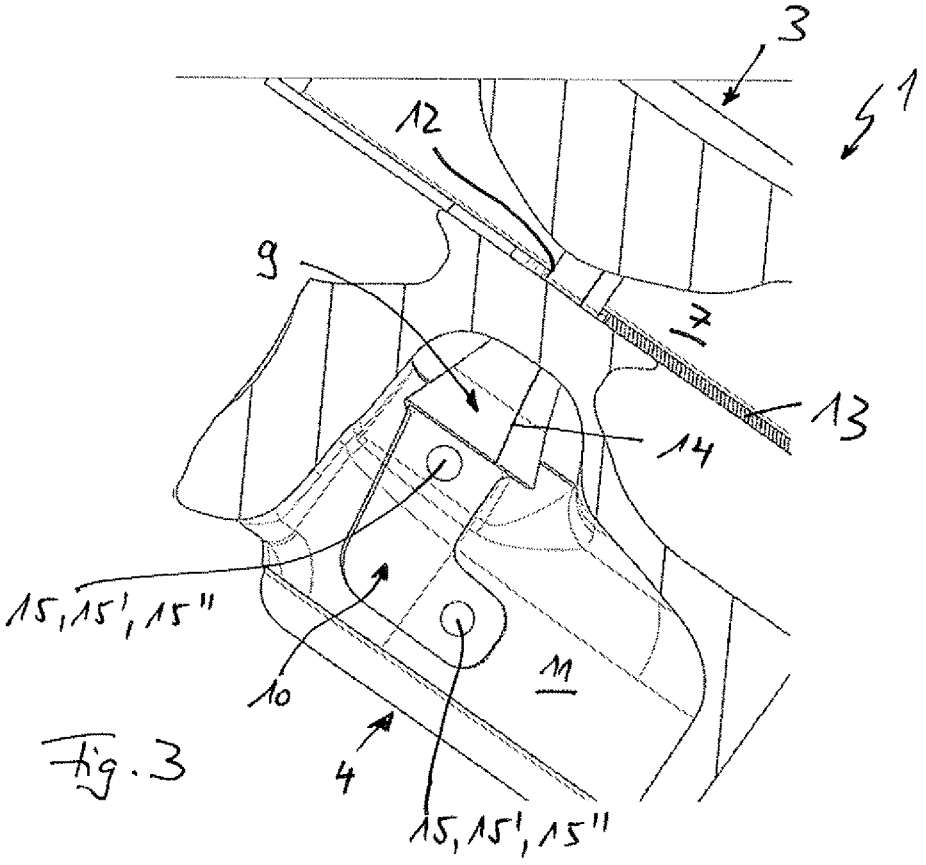
Figure 4:
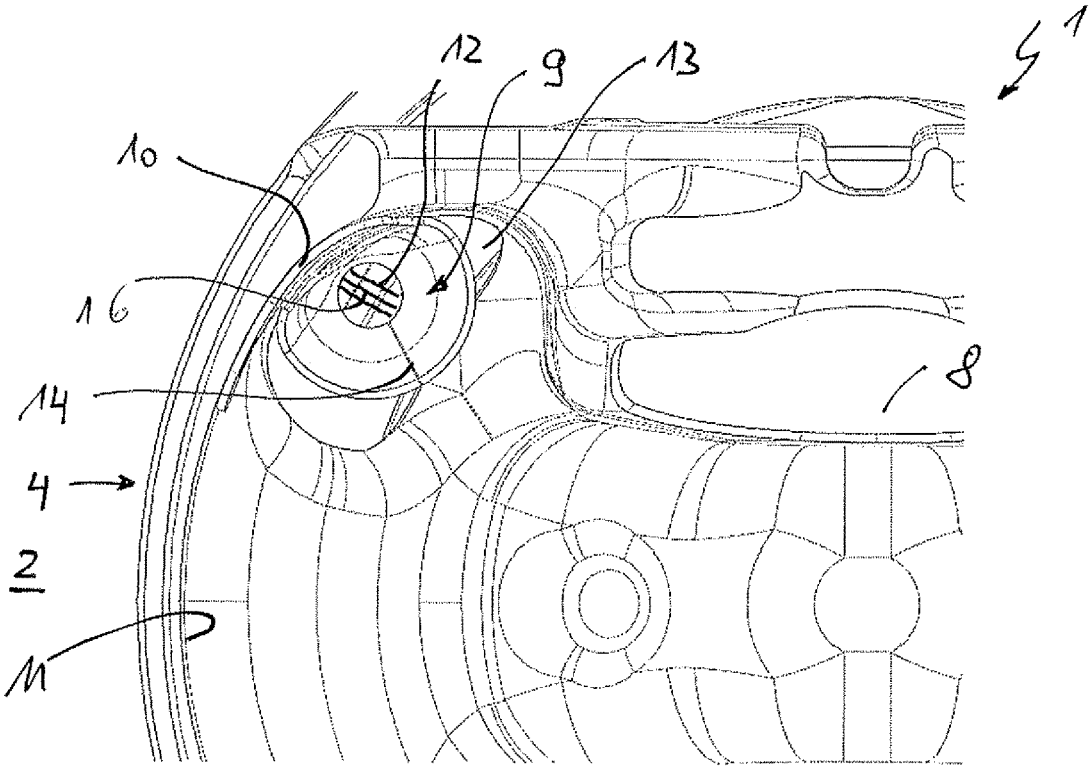

If FIGS. 1 to 3 are considered further, it can be discerned that the feed hopper 9 shown therein has been connected—for instance, via two welding-points 15—to the inside 11 of the piston skirt 4. Alternatively, the circles that are shown may, of course, also represent soldering-points 15' or adhesion-points 15". A full-surface soldering or gluing of the retaining lug 10 of the feed hopper 9 to the inside 11 of the piston skirt 4 is also conceivable of course. In order to enable a connection between the retaining lug 10 and the piston 1 that is as stable as possible, the retaining lug 10 exhibits a shape that is complementary to the region of the piston 1 to which it will later be fastened. According to FIG. 4, the retaining lug 10 exhibits, for instance, a curved shape corresponding to the inside 11 of the piston skirt 4.

Purely theoretically, the feed hopper 9 also does not have to exhibit an actual hopper shape at all but may also take the form of a deflector plate, so it does not have to possess a conical shape but may also take the form of a simple, obliquely inclined or bent pipe or metal sheet. Via the retaining lug 10 according to the invention, the fastening of such geometrical shapes is also possible comparatively easily. By virtue of the piston 1 according to the invention, in addition it is also possible to provide larger and heavier feed hoppers 9, since they have no longer been fastened to the cooling-duct cover 13 as hitherto, they no longer even touch the latter, so the latter can be designed to be thinner and hence lighter, since it no longer has to take up any mass-induced inertial forces of the feed hopper 9.

Figure 5:
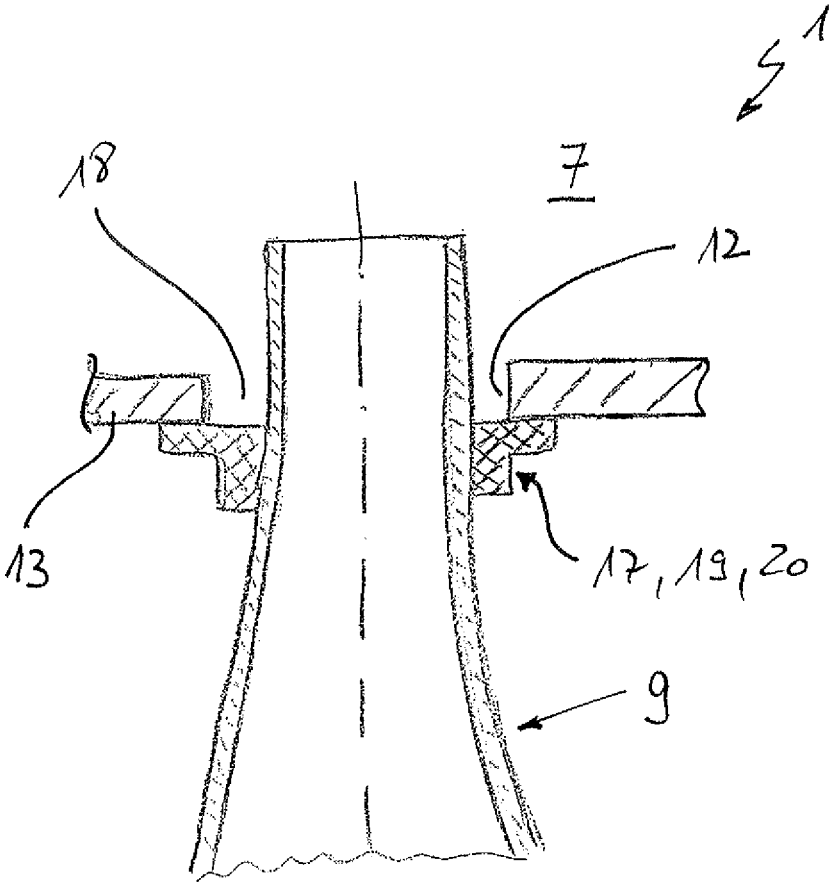

If FIG. 5 is considered, a sealing element 17 can be discerned therein, by means of which an uncontrolled drainage of oil from the cooling duct 7 via a gap (an annular gap) 18 which is present between the edge of the feed aperture 12 and the feed hopper 9 can be prevented. The sealing element 17 can close the gap 18 entirely or partially. This can be done by an appropriate geometrical configuration of the feed hopper 9, for example in the form of a headed flange directed radially outwards—that is to say, a sealing element 13 integrally formed with the feed hopper 9. Instead of this, the sealing element 13 may also have been realised as an additional component part, for example as a rubber gasket 19 surrounding the feed hopper 9 in the form of a ring. Similarly, the sealing element 13 could be formed by the application of a sealing compound 20 which closes the annular gap 18 or at least makes it smaller.

Generally, with the piston 1 according to the invention and with the feed hopper 9 according to the invention it is also possible to fit said feed hopper independently of, for instance, a joint of two cooling-duct-cover metal sheets constituting the cooling-duct cover 13.

The invention claimed is:

1. A piston of an internal-combustion engine, comprising:
a piston head and a piston skirt;
a cooling duct circulating in the piston head;
a boss for receiving a piston pin; and
a feed hopper for supplying cooling oil into the cooling duct;
wherein the feed hopper is fastened to another component of the piston via a retaining lug by at least one of a material closure, a force closure, and a positive closure;
wherein the retaining lug is L-shaped with an L-shank extending in a peripheral direction of the piston.

2. The piston according to claim 1, wherein the feed hopper is fastened via the retaining lug to an inside of the piston skirt or to the boss.

3. The piston according to claim 1, further comprising a slipper-skirt wall, wherein the feed hopper is fastened via the retaining lug to the slipper-skirt wall.

4. The piston according to claim 1, wherein
the retaining lug is integrally formed with the feed hopper.

5. The piston according to claim 1, wherein the cooling duct has a feed aperture through which the feed hopper protrudes.

6. The piston according to claim 1, further comprising a cooling-duct cover that includes a feed aperture through which the feed hopper protrudes.

7. The piston according to claim 6, wherein the feed hopper is not in contact with the cooling-duct cover.

8. The piston according to claim 5, further comprising a sealing element which at least partially closes a gap between the feed hopper and an edge of the feed aperture.

9. The piston according to claim 1, wherein the feed hopper has a diverting device via which cooling oil injected into the feed hopper is diverted in a peripheral direction of the cooling duct.

10. The piston according to claim 1, wherein the feed hopper is a slotted sheet-metal shaped part.

11. An internal-combustion engine comprising at least one piston including:
a piston head and a piston skirt;
a cooling duct circulating in the piston head;
a boss for receiving a piston pin; and
a feed hopper for supplying cooling oil into the cooling duct;
wherein the feed hopper is fastened to an inside of the piston skirt or to the boss via a retaining lug by at least one of a material closure, a force closure, and a positive closure.

12. The internal-combustion engine according to claim 11, wherein the at least one piston further includes a slipper-skirt wall, and wherein the feed hopper is fastened via the retaining lug to the slipper-skirt wall.

13. The internal-combustion engine according to claim 11, wherein at least one of:
the retaining lug is L-shaped with an L-shank extending in a peripheral direction of the piston; and
the retaining lug is integrally formed with the feed hopper.

14. The internal-combustion engine according to claim 11, wherein the cooling duct has a feed aperture through which the feed hopper protrudes.

15. The internal-combustion engine according to claim 11, wherein the at least one piston further includes a cooling-duct cover that includes a feed aperture through which the feed hopper protrudes.

16. The internal-combustion engine according to claim 15, wherein the feed hopper is not in contact with the cooling-duct cover.

17. The internal-combustion engine according to claim 14, wherein the at least one piston further includes a sealing element which at least partially closes a gap between the feed hopper and an edge of the feed aperture.

18. The internal-combustion engine according to claim 11, wherein the feed hopper has a diverting device via which cooling oil injected into the feed hopper is diverted in a peripheral direction of the cooling duct.

19. A piston of an internal-combustion engine, comprising:
a piston head and a piston skirt;
a cooling duct circulating in the piston head;
a boss for receiving a piston pin; and
a feed hopper for supplying cooling oil into the cooling duct;
wherein the feed hopper is fastened to another component of the piston via a retaining lug by at least one of a material closure, a force closure, and a positive closure;
wherein the retaining lug is L-shaped with an L-shank extending in a peripheral direction of the piston; and
wherein the cooling duct has a feed aperture through which the feed hopper protrudes.

20. A piston of an internal-combustion engine, comprising:

a piston head and a piston skirt;

a cooling duct circulating in the piston head;

a boss for receiving a piston pin; and a feed hopper for supplying cooling oil into the cooling duct;

wherein the feed hopper is fastened to another component of the piston via a retaining lug by at least one of a material closure, a force closure, and a positive closure;

wherein the retaining lug is formed integrally with the feed hopper; and wherein the feed hopper is a slotted sheet-metal shaped part.

* * * * *